US005655661A

United States Patent [19]

Rigby

[11] Patent Number: 5,655,661

[45] Date of Patent: Aug. 12, 1997

[54] WRAPPER FOR FLANGED TRAY WITH OPENING FEATURE

[75] Inventor: William R. Rigby, Newark, Del.

[73] Assignee: Westvaco Corporation, New York, N.Y.

[21] Appl. No.: 633,536

[22] Filed: Apr. 17, 1996

Related U.S. Application Data

[63] Continuation of Ser. No. 207,068, Mar. 8, 1994, abandoned.

[51] Int. Cl.[6] ..... B65D 5/54

[52] U.S. Cl. ..... 206/557; 229/207; 229/209; 229/125.35; 229/925

[58] Field of Search ..... 206/557, 491, 206/492, 524.9, 525, 525.1; 229/925, 207, 208, 209, 125.35

[56] References Cited

U.S. PATENT DOCUMENTS

| | | | |
|---|---|---|---|
| 2,583,211 | 1/1952 | Fleming | 229/925 X |
| 3,116,002 | 12/1963 | Crawford et al. | 229/17 |
| 3,270,940 | 9/1966 | Egleston et al. | 229/17 |
| 3,281,051 | 10/1966 | O'Brien et al. | 206/491 |
| 3,286,909 | 11/1966 | Scharre | 229/207 |
| 3,346,166 | 10/1967 | Koolnis | 229/209 X |
| 3,580,478 | 5/1971 | Bemiss | 229/43 |
| 3,862,703 | 1/1975 | Dutcher | 221/63 |
| 4,531,668 | 7/1985 | Forbes, Jr. | 229/207 X |
| 4,550,834 | 11/1985 | Fletcher et al. | 229/925 X |
| 4,946,042 | 8/1990 | Ferreri et al. | 229/925 X |
| 5,090,615 | 2/1992 | Hopkins et al. | 229/125 |
| 5,330,099 | 7/1994 | Beales et al. | 229/207 |

*Primary Examiner*—Jacob K. Ackun

[57] ABSTRACT

A package comprising a flanged tray and a wrapper for covering the tray includes an easy opening feature for providing access to the contents of the tray. The wrapper is formed from a substantially rectangular blank of paperboard which is cut and scored to provide a top panel which is adhered to the tray flange, at least one side wall foldably attached to the top panel which lies adjacent to a tray side wall and a bottom flap foldably attached to the side wall which is adhered to the bottom of the tray. The easy opening feature includes a tab element formed from a part of the side panel which is connected to a removable lid portion of the top panel. The tab element and removable lid portion are formed by spaced apart, partial depth cut lines located on the inner and outer surfaces of the top panel and the side panel.

10 Claims, 2 Drawing Sheets

WRAPPER FOR FLANGED TRAY WITH OPENING FEATURE

This is a continuation of application Ser. No. 08/207,068 filed Mar. 8, 1994 and now abandoned.

BACKGROUND OF INVENTION

The present invention relates to a package for foodstuffs or the like which comprises a flanged tray and a wrapper for covering the tray. Packages of the type disclosed herein are shown in U.S. Pat. No. 5,090,615 ('615). In this regard, the present invention is an improvement in the package shown in the '615 patent.

As illustrated, it will be seen that the package of the '615 patent is opened by pushing down at one corner of the lid to rupture previously cut lines in the lid thereby permitting removal of a portion of the lid. This type of opening scheme has been used in the past for food packages with either an integral or a separate lid. However, experience has shown that such an opening scheme is unreliable in practice and difficult to start. U.S. Pat. No. 3,281,051 ('051) discloses another type of food package, prepared from aluminum foil, that is encased in an outer wrapper. In the '051 patent, a removal tab 24 is incorporated into the wrapper for removing the lid. Unfortunately, access to the tab 24 in the '051 patent is restricted and difficult to start. In contrast, the tear strip on the top wall of the package shown in U.S. Pat. No. 3,580,478 is exposed and subject to being inadvertently damaged or prematurely opened. Thus there is a clear need to provide a more reliable and accessible opening scheme for food packages which include overwraps as disclosed herein. To address this need, the present invention was developed.

SUMMARY OF INVENTION

The opening scheme of the present invention is designed primarily for use in packaging wherein the package constitutes a separate tray and lid. The lid is preferably formed by a wrapper which encloses substantially the entirety of the tray. In its most elementary form, the present invention relates to packaging wherein a flanged tray is closed by a wrapper which includes at least a top panel, a side panel and a bottom flap. The top panel of the wrapper is adhered to the tray flange after it is filled with food. The side panel of the wrapper is arranged to lie generally perpendicular to the top panel along an adjacent side wall of the tray, and the bottom flap is folded underneath the tray and adhered to the bottom of the tray to complete the enclosure. The wrapper may also include additional side walls foldably attached to the top panel which are arranged along adjacent side walls of the tray and additional bottom flaps. If desired, the bottom flaps could be arranged to overlap one another to completely surround and enclose the tray substantially as shown in the '051 patent.

The novelty of the present invention lies in the easy opening feature applied to the wrapper as described above. For this purpose, a pair of spaced apart, partial depth cut lines of weakness are applied respectively to the inner and outer surfaces of the top panel to define a removable lid portion which provides access to the tray contents. Opening schemes of this type are well known in the art particularly as disclosed in U.S. Pat. No. 4,531,668, owned by the present assignee herein. The improvement disclosed herein comprises the addition of a tab element that is integral with the removable lid portion and located wholly within an attached side wall of the wrapper, a cut out in the side wall which provides easy access to the tab element, and the use of an abhesive rather than adhesive between the tray flange and the top wall in the region of the top wall where the removable lid portion is connected to the tab element. The use of an abhesive in this region is designed to allow a clean release of the part of the removable lid portion that is connected to the tab element from the tray flange, without inadvertently separating the tab element from the removable lid portion. The use of an abhesive in this region also allows the tray to be partially opened initially to provide a vent for the release of steam when the contents of the package are cooked in a microwave oven. After cooking, the lid may then be completely removed for serving. The term abhesive as used herein is defined in prior U.S. Pat. Nos. 3,116,002 and 3,270,940, the disclosures of which are incorporated herein by reference.

DETAILED DESCRIPTION

Figure 1:
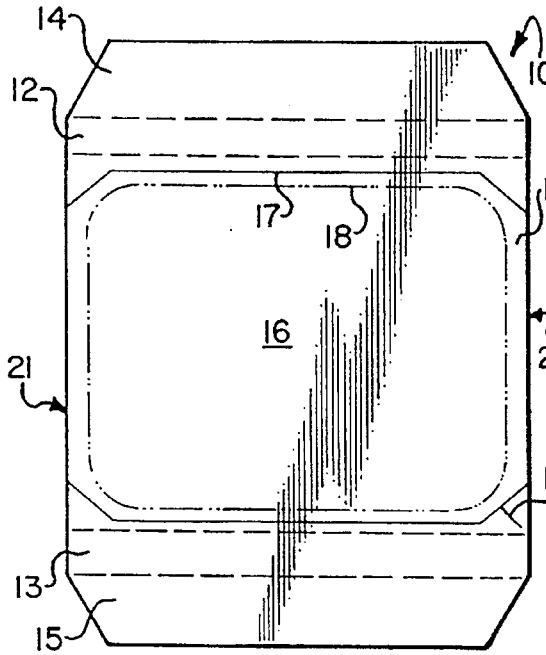
FIGURE 1 PRIOR ART
FIG. 1 is a plan view showing a typical blank for a wrapper used in the prior art.
Figure 3:
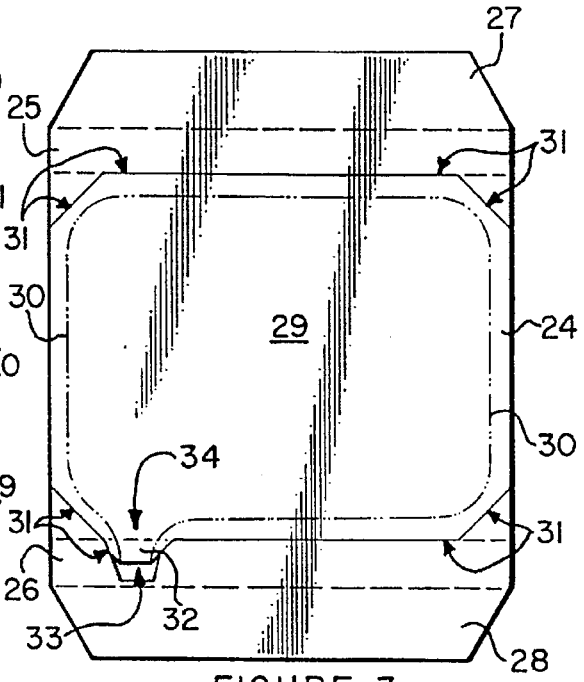
FIG. 3 is a plan view of a typical blank for the wrapper of the present invention.
Figure 2:
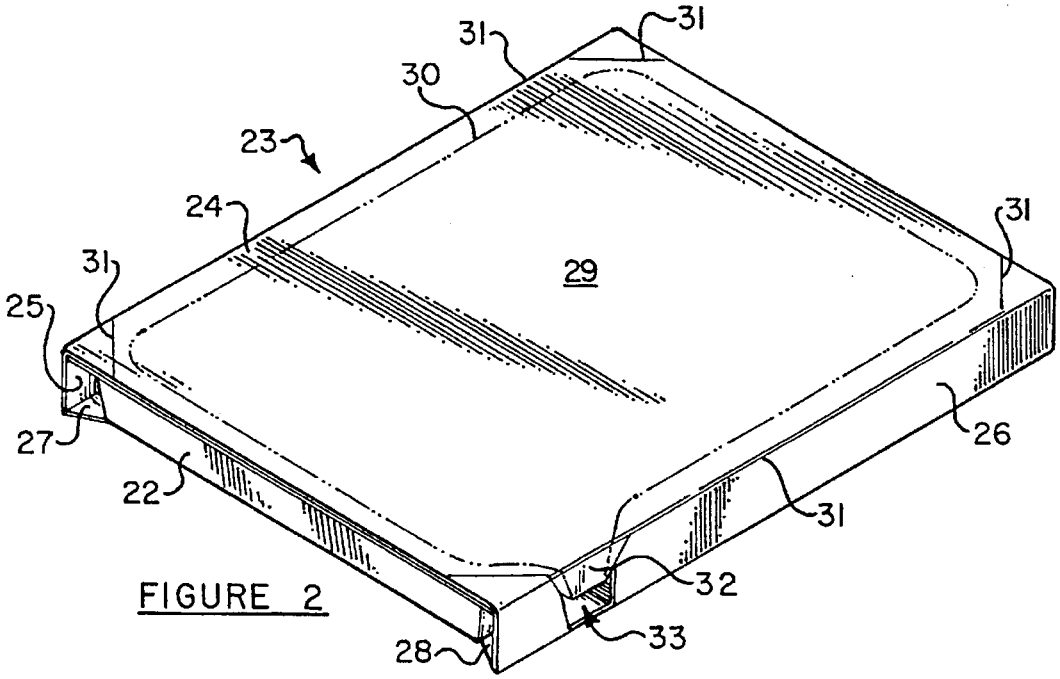
FIG. 2 is a perspective view of a package according to the present invention which incorporates the easy opening feature of the present invention.

Referring now to the drawings, FIG. 1 illustrates the opening scheme presently in use that is applied to prior art wrappers of the type disclosed herein. The wrapper 10 includes a central lid panel 11, a pair of side wall panels 12, 13 separated from the lid portion 11 by score lines and a pair of bottom flaps 14, 15 joined to the side wall panels along score lines. The central lid panel 11 includes a removable lid portion 16 defined therein by a pair of spaced apart, partial depth cut lines 17 and 18 located on the inner and outer surfaces thereof. The partial depth cut line preferably located on the exterior of the blank 10 and includes opposed portions which coincide substantially with the edges of the blank at 20 and 21. Meanwhile the partial depth cut line 18 preferably is applied to the interior of the blank 10 and is located to lie interiorly of the inner edge of the flange of any tray to which the lid is adhered. An additional partial depth cut line 19 is also applied to the exterior surface of the blank 10 arranged to extend from one corner of the blank generally perpendicular to the cut line 17 at one corner of the blank. This arrangement is intended to provide an initiation point for breaking through the top panel 11 and providing access to a corner of the removable lid portion 16 for opening the package. However, this scheme is unreliable in practice and more often than not fails to produce the desired result. To overcome these problems and to provide a more reliable opening device, the package illustrated in FIG. 2 was developed. As shown in FIG. 2, the tray 22 is enclosed within a wrapper 23 that includes a top panel 24, a pair of side walls 25, 26 and a pair of bottom flaps 27, 28. The top panel 24 includes a removable portion 29 defined therein by a partial depth cut line 30 applied to the inner surface of the top panel 29, and partial depth cut lines 31 located at each corner and along the outer edges of the top panel 29 coincident with the fold lines connecting the top panel 29 to the side walls 25, 26. The partial depth cut lines 30 and 31 are illustrated as continuing into side panel 26 to define a tab element 32 and an access opening 33. The blank structure useful for forming the wrapper 23 is shown in FIG. 3. The blank of FIG. 3 is essentially identical to the prior art blank except for the novel opening scheme of the present invention. It will be noted in FIG. 3 that the inner partial depth cut line 30 extends completely around the periphery of the top panel 24 and into the area of the side wall 26 where the tab 32 is located. The space between the partial depth cut lines 30 and 31 provides a delamination area so that a part of the top panel 24 will remain attached to the tray flange when the removable lid portion 29 is removed. The cut out 33 provides convenient access to the end of tab 32. When tab 32 is lifted, the paperboard begins to delaminate between the partial depth cut lines 30 and 31, and the removable lid portion 29 can be torn off. The reliability of this arrangement is accommodated because of the use of an abhesive material in the area 34 of the lid-to-tray flange bond, thereby insuring that the tab 32 remains a part of the removable lid portion 29 when the tab 32 is lifted. The abhesive could be omitted, if desired, in those cases where a tight seal between the lid and tray was not required. However, the use of an adhesive connection in that area would run the risk of rupturing the connection between the tab element 32 and the removable lid portion 29.

Figure 4:
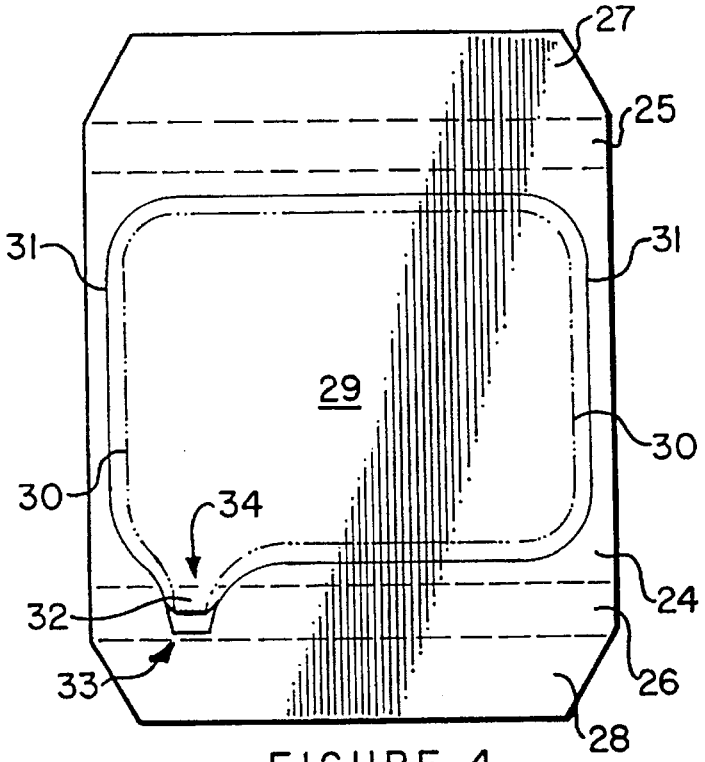
FIG. 4 is a plan view of a second embodiment of a blank for the wrapper of the present invention.
Figure 5:
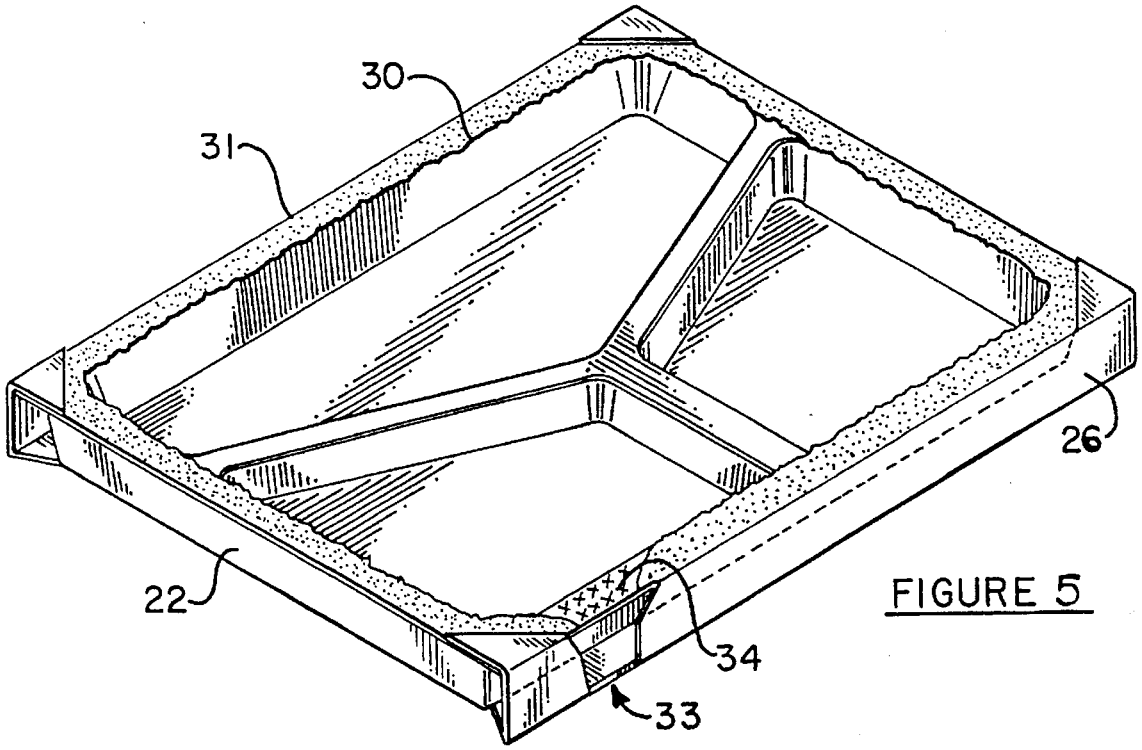
FIG. 5 is a perspective view showing the package of FIG. 3 opened to provide access to the contents.

A package with the lid removed is illustrated in FIG. 5. Note the delamination area around the entirety of the wrapper 23 adjacent to the opening created by removing lid portion 29. This delamination area coincides substantially with the part of the top panel 24 that is bonded to the tray flange for this embodiment. The tray flange has an inside edge and an outside edge with the inside edge being located closer to the interior of the tray than the outside edge. Thus for this embodiment, the partial depth cut line 30 on the inner surface of top panel 24 is substantially coincident with the inside edges of the tray flange, and the partial depth cut lines 31 on the outer surface of the top panel 25 are located substantially coincident with the outside edges of the tray flange. In the embodiment illustrated in FIG. 4, both of the partial depth cut lines 30, 31 are located interiorly of the inside edges of the tray flange. This arrangement provides a smaller opening for the tray, but leaves additional paperboard completely surrounding the tray to reinforce the tray structure. The arrangement shown in FIG. 4 would be desirable for packages which contained food products which were heavier than normal.

It will be understood that a wide range of changes and modification may be made to the embodiments described above within the scope of the present invention. As mentioned before, even though only one side wall and one bottom flap may be employed, the side and bottom flaps may also be applied in any combination of the sides of the package on one, two, three or all sides. It is therefor intended that the fore-going description be regarded merely as illustrative rather than limiting, and it is understood that it is the following claims, including all equivalents, which are intended to define the scope of the invention.

What is claimed is:

1. A food package comprising, in combination, an open top flanged tray and a cover for said tray, said cover comprising a wrapper having a top panel with inner and outer surfaces, a removable lid portion formed in the top panel by a pair of spaced apart, partial depth cut lines of weakness located respectively on the inner and outer surfaces of the top panel, at least one side panel foldably connected to an edge of said top panel and at least one bottom flap foldably connected to an edge of said side panel, adhesive means between the top panel and the tray flange for bonding the inner surface of the top panel to the flange area of the tray, the improvement comprising means for separating the removable lid portion from the top panel to open the package, said separating means including a tab element joined to the removable lid portion and formed from a part of the side panel, a cut out in the side panel adjacent to the tab element which exposes an edge of the tab element and a releasible connection comprising an abhesive means in the bond between the tray flange and top panel in the region adjacent to the tab element where the tab element is joined to the removable lid portion, to prevent the inadvertent separation of the tab element from the removable lid portion when the package is opened.

2. The package of claim 1 wherein the tab element is formed in the side panel by extensions of the partial depth cut lines of weakness from said top panel.

3. The package of claim 2 wherein the side wall panel is arranged to be substantially perpendicular to the top panel and the bottom flap is adhered to the bottom of the flanged tray.

4. The package of claim 3 wherein the tray flange has an inside edge and an outside edge with the inside edge being located closer to the interior of the tray than the outside edge, and the partial depth cut lines of weakness which define the removable lid portion are located in the top panel so that the cut line on the inner surface of the top panel coincides substantially with the inside edge of the tray flange, and the cut line on the outer surface of the top panel coincides substantially with the outside edge of the tray flange.

5. The package of claim 3 wherein the tray flange has an inside edge and an outside edge with the inside edge being located closer to the interior of the tray than the outside edge, and the partial depth cut lines of weakness which define the removable lid portion are located in the top panel as so to both lie interiorly of the inside edge of the tray flange.

6. The package of claim 2 wherein the wrapper includes at least two opposed ends, side panels foldably attached along each of the two opposed ends and bottom flaps foldably attached to each of said side panels, said side panels being arranged to lie at substantially right angles to said top panel and said bottom flaps being adhered to the bottom of the tray.

7. The package of claim 6 wherein the tray flange has an inside edge and an outside edge with the inside edge being located closer to the interior of the tray than the outside edge, and the two opposed ends of the top panel lie substantially along two opposed outside edges of the tray flange.

8. The package of claim 7 wherein the partial depth cut lines of weakness on the outer surface of the top panel at the two opposed ends of the wrapper coincide substantially with the connections between the top panel and the two opposed side walls, and the partial depth cut line of weakness on the inner surface of the top panel coincides substantially with the inside edge of the tray flange.

9. A food package comprising, in combination, an open top tray and a cover for said tray, said tray comprising a bottom wall of generally rectangular shape, a peripheral side wall surrounding the bottom wall and connected thereto, and a continuous upper flange surrounding the side wall and connected thereto, said flange having an inside edge and an outside edge, said inside edge being closer to the interior of the tray than the outside edge, said tray cover comprising a wrapper with two opposed ends, a centrally located top panel having inner and outer surfaces and having the same general shape as the tray bottom wall located between the two opposed ends of said wrapper, a pair of side walls foldably attached respectively to the two opposed ends of the wrapper, and a pair of bottom flaps foldably attached respectively to exposed edges of said side walls, said side walls being arranged to lie substantially perpendicular to said top wall and adjacent to opposed portions of the side wall of the tray, a removable lid portion formed in the top panel by a pair of spaced apart, partial depth cut lines applied respectively to the inner and outer surfaces of the top panel, said cut lines being located so as to coincide substantially with the inside and outside edges of the tray flange, and adhesive means between the top panel and the tray flange for bonding the inner surface of the top panel of the wrapper to substantially the entirety of the flange portion of the tray, and between the bottom flaps of the wrapper and the bottom wall of the tray for bonding the bottom flaps to the tray, the improvement comprising a means for separating the removable lid portion from the top panel of the wrapper, said separating means comprising a tab element integral with the removable lid portion of the top panel that is formed in one of the side walls of the wrapper by extensions of the spaced apart, partial depth cut lines from the top panel into the side wall, a cut out in the side wall adjacent to the tab element which exposes an edge of the tab element and a releasible connection comprising an abhesive in the bond between the tray flange and the top panel in the region adjacent to the tab element where the tab element is joined to the removable lid portion to prevent the inadvertent separation of the tab element from the removable lid portion when the package is opened.

10. The package of claim 9 wherein the wrapper is made of paperboard and the space between the inner and outer partial depth cut lines defines a ply separation area between said cut lines when the removable lid portion of the top panel is removed to open the package.

* * * * *